US008556032B1

(12) United States Patent
Cuellar et al.

(10) Patent No.: US 8,556,032 B1
(45) Date of Patent: Oct. 15, 2013

(54) FENCE LADDER

(76) Inventors: Jose A. Cuellar, DeLeon, TX (US); Margaret Cuellar, DeLeon, TX (US)

( * ) Notice: Subject to any disclaimer, the term of this patent is extended or adjusted under 35 U.S.C. 154(b) by 79 days.

(21) Appl. No.: 13/215,423

(22) Filed: Aug. 23, 2011

Related U.S. Application Data

(60) Provisional application No. 61/405,779, filed on Oct. 22, 2010.

(51) Int. Cl.
*E06C 9/00* (2006.01)
*E06C 1/00* (2006.01)

(52) U.S. Cl.
USPC ..... 182/93; 182/165

(58) Field of Classification Search
USPC ..... 182/23, 25, 93, 165, 206
See application file for complete search history.

(56) References Cited

U.S. PATENT DOCUMENTS

| | | | | |
|---|---|---|---|---|
| 286,226 | A | 10/1883 | Rodden | |
| 1,961,289 | A * | 6/1934 | Gardner | 182/206 |
| 3,991,525 | A * | 11/1976 | Oswald | 451/421 |
| 4,265,333 | A | 5/1981 | Rowell et al. | |
| 4,830,142 | A | 5/1989 | McManus | |
| 5,638,918 | A * | 6/1997 | Hebda et al. | 182/151 |
| 6,247,553 | B1 | 6/2001 | Jones | |
| 6,394,228 | B1 | 5/2002 | Stephens et al. | |
| 7,434,661 | B1 | 10/2008 | Storey | |
| 2003/0132058 | A1 * | 7/2003 | Pollock | 182/25 |
| 2006/0169535 | A1 * | 8/2006 | Phillips et al. | 182/119 |
| 2007/0175700 | A1 | 8/2007 | Moeller | |

* cited by examiner

*Primary Examiner* — Alvin Chin Shue
(74) *Attorney, Agent, or Firm* — Kenneth L Tolar

(57) ABSTRACT

A fence ladder includes a front section and a rear section for straddling a wire fence. Each section is formed of a pair of risers with a plurality of ladder rungs perpendicularly disposed therebetween. The upper ends of the two sections are joined with a hinge having a post receiver depending therefrom. The receiver includes a cylindrical shell having a plurality of peripheral notches that are each positioned, spaced and dimensioned to receive the outwardly-extending flanges found on a typical T-post. A pair of releasable locks fix the two sections about a fence to prevent separation and shifting.

6 Claims, 2 Drawing Sheets

FENCE LADDER

CROSS REFERENCE TO RELATED APPLICATIONS

This application is entitled to the benefit of provisional application No. 61/405, 779 filed on Oct. 22, 2010.

BACKGROUND OF THE INVENTION

The present invention relates to a ladder that allows a user to easily traverse wire fences.

DESCRIPTION OF THE PRIOR ART

In order to traverse a barbed-wire fence, one must pass between an adjacent pair of wire strands, which is cumbersome and difficult, and often results in torn clothing. Slipping beneath a lowermost strand is more cumbersome and soils one's clothing, while climbing over an uppermost strand can damage the fence. Accordingly, there is currently a need for a device that assists a user with traversing a wire fence.

A review of the prior art reveals several devices that are designed to assist a person with climbing various types of fences. For example, U.S. patent publication no. 2007/0175700 to Moeller discloses a step that is attachable to a fence T-post.

U.S. Pat. No. 7,434,661 issued to Storey discloses a portable ladder for climbing a fence or another vertical barrier having a base frame with a plurality of steps on each of two sides thereof. The frame includes a U-shaped channel at an upper end for gripping a fence rail.

U.S. Pat. No. 6,247,553 issued to Jones discloses a step assembly for a T-post on a barbed-wire fence including a first step engaging a front side of the post and a second, diametrically-opposed step engaging a rear surface of the post.

U.S. Pat. No. 4,830,142 issued to McManus discloses a portable fence stile including a hollow tube dimensioned to receive a barbed-wire fence post; the tube includes a pair of slots that receive barbed wires when the tube is superimposed on the post. A pair of opposing steps extend from a lower portion of the tube to allow a user to easily climb over the fence.

U.S. Pat. No. 4,265,333 issued to Rowell et al. discloses a portable fence stile including a U-shaped frame formed of a pair of legs that straddle a barbed-wire fence, each having a foot support thereon. A plate positioned between the legs includes an opening for receiving the upper end of a fence post.

U.S. patent no. 286,226 issued to Rodden discloses a stile for wire fences including a pair of side rails with steps therebetween.

U.S. Pat. No. 6,394,228 issued to Stephens et al. discloses a stile for a T-post including a pair of plates, each having an intermediate portion that is bent to conform to the post; the plates straddle the post and are joined to provide a step for a user when climbing the fence.

As indicated above, several stiles for wire fences exist in the prior art. Though the patent to Rodden discloses a ladder for a barbed wire fence, the device is primarily supported by a pair of beams that are superimposed on an uppermost wire strand. Accordingly, the device easily sways and shifts when a climber is standing thereon. Though the devices of Stephens and McManus are configured to attach to a wire-fence post, they only have a single step, which is useless for higher fences or shorter climbers. Furthermore, the prior art devices that are attachable to a T-post include unreliable fasteners that can detach and dislodge a climber.

The present invention overcomes the disadvantages of the prior-art fence stiles by providing a ladder having a central receiver that is configured to securely conform to the upper end of a T-post. Furthermore, the device includes a brace for gripping an intermediate portion of the T-post and a locking mechanism that secures a front ladder section to a rear section to prevent separation or shifting during use.

SUMMARY OF THE INVENTION

The present invention relates to a fence ladder including a front section and a rear section for straddling a wire fence. Each section is formed of a pair of risers with a plurality of ladder rungs perpendicularly disposed therebetween. The upper ends of the two sections are joined with a hinge having a post receiver depending therefrom. The receiver includes a cylindrical shell having a plurality of peripheral notches that are each positioned, spaced and dimensioned to receive the outwardly-extending flanges found on a typical T-post. A pair of releasable locks fix the two sections about a fence to prevent separation and shifting.

It is therefore an object of the present invention to provide a fence ladder that allows a user to quickly and easily traverse a wire fence. It is another object of the present invention to provide a fence ladder that may be quickly and easily installed or removed.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
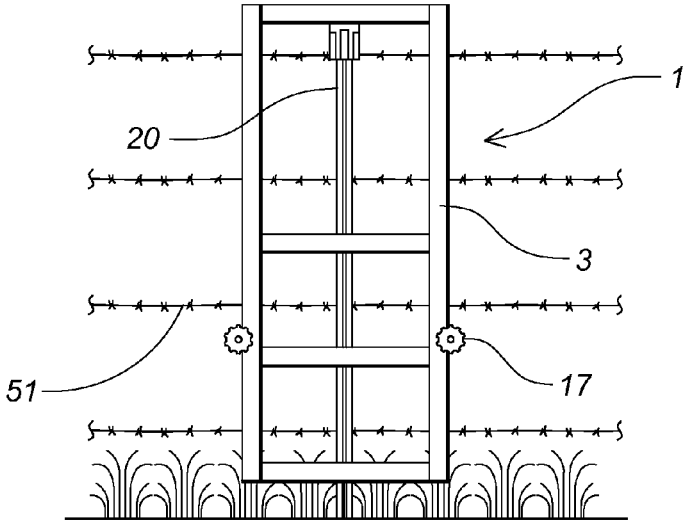
FIG. 1 is a front, plan view of the ladder according to the present invention properly installed on a wire fence.
Figure 2:
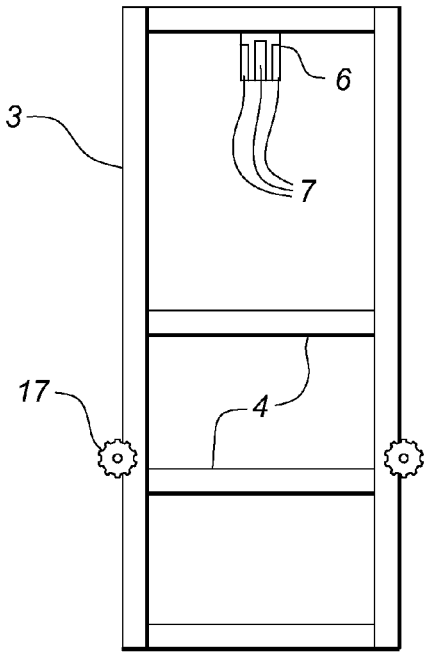
FIG. 2 is a front, plan view of the fence ladder.
Figure 3:
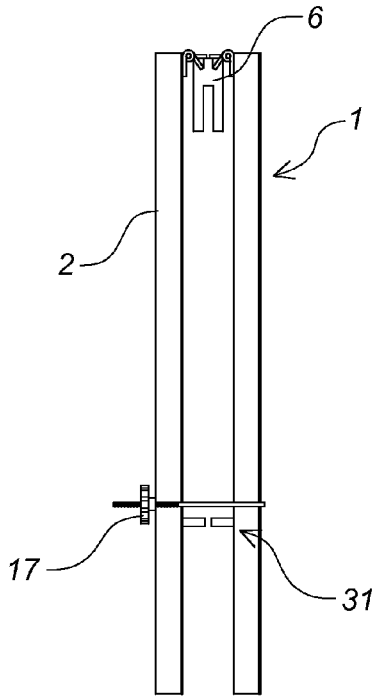
FIG. 3 is a side view of the fence ladder.
Figure 4:
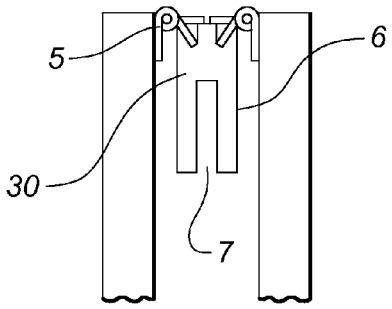
FIG. 4 is an isolated, detailed view of the hinge and post receiver.
Figure 5:
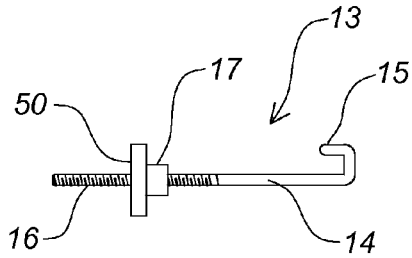
FIG. 5 is an isolated view of an exemplary lock.
Figure 6:
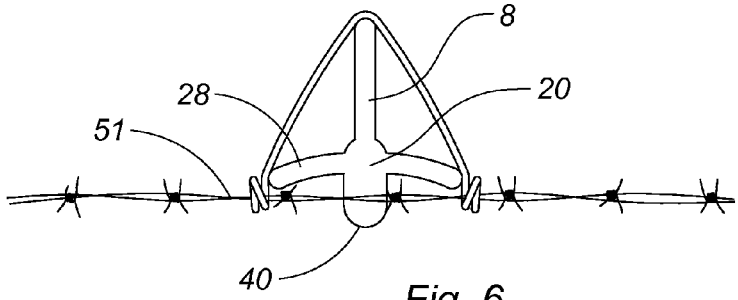
FIG. 6 is a top view of a typical T-post.
Figure 7:
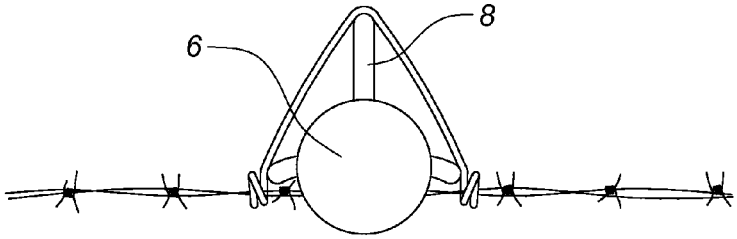
FIG. 7 is a top view of the T-post of FIG. 6 with the post receiver properly mounted thereon.
Figure 9:
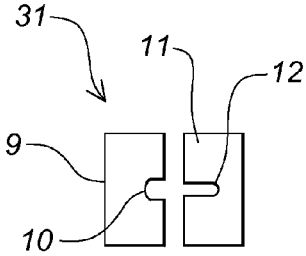
FIG. 9 is an isolated view of the brace mechanism.
Figure 8:
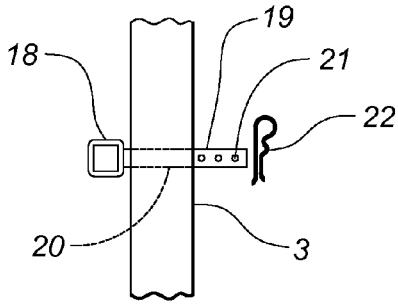
FIG. 8 is an isolated view of the lock receptacle.

The present invention relates to a fence ladder comprising a front section 1 and a rear section 2, each section formed of a pair of risers 3 with a plurality of ladder rungs 4 perpendicularly disposed therebetween. Preferably, the upper surface of each rung includes a non-skid layer to prevent a climber from slipping. The upper ends of the two sections are joined with a double hinge 5 having a post receiver 6 depending therefrom. The receiver 6 is formed of a cylindrical shell 30 having a plurality of peripheral notches 7 that are each positioned, spaced and dimensioned to receive either the outwardly-extending front flange 8 or one of the side flanges 28 found on a typical T-post 20.

The ladder further includes a brace mechanism 31 for releasably gripping opposing portions of the T-post. On an intermediate rung of the rear section is a first plate 9 having a wide, shallow indention 10 for receiving the slightly-protruding longitudinal ridge 40 on the T-post. A second plate 11 similarly positioned on the front section includes a narrow, deep slot 12 for receiving the outwardly-extending flange 8 on the front surface of the post.

The two sections are fixed about a fence with a pair of locks 13, each including a rod 14 having a U-shaped latch 15 at one end and a threaded portion 16 at an opposing end. An internally-threaded locking knob 17 attachable to the threaded end of the rod is rotated to tighten the latch 15 against one of the risers, and a flat portion 50 of the knob against a facing riser. A receptacle 18 for storing the locks when not in use includes a shaft 19 extending through an opening 20 formed through one of the risers; the shaft includes multiple apertures 21 for receiving a pin 22 to secure the receptacle to the ladder.

To traverse a fence, a user removes the locks and positions the ladder such that the front and rear sections straddle the wire-fence strands 51. The post receiver is superimposed on the upper end of a T-post with the flanges firmly received within their corresponding notches. The locks are reattached and tightened until the brace plates firmly grip opposing sides of the post. Accordingly, the fence can be easily and safely traversed by climbing the ladder. When no longer needed, the ladder is easily removed and stored.

The above-described device is not limited to the exact details of construction and enumeration of parts provided herein. Furthermore, the size, shape and materials of construction of the various components can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A fence ladder comprising:

a front section and a rear section, said front section and said rear section each formed of a pair of risers with a plurality of rungs disposed therebetween;

a post receiver between said front section and said rear section, said receiver formed of a shell having a plurality of peripheral notches that are each positioned, spaced and dimensioned to receive outwardly-extending flanges on a fence post;

a first plate on one of said rungs on said front section, said first plate having a first indention configured to conform to a front surface of a fence post;

a second plate on one of said rungs on said rear section, said second plate having a second indention configured to conform to a rear surface of a fence post.

2. The fence ladder according to claim 1 further comprising means for locking said front section to said second section to prevent shifting and separation.

3. The fence ladder according to claim 2 wherein said means for locking said front section to said second section comprises:

a rod having a latch at one end gripping one of said risers and a threaded portion at an opposing end;

a threaded locking knob attachable to the threaded end of said rod that is rotated to tighten said latch against said one of said risers, and to tighten said knob against another of said risers.

4. The fence ladder according to claim 1 wherein said first indention is dimensioned and configured to receiving an outwardly-extending flange on a T-post.

5. The fence ladder according to claim 3 wherein said second indention is dimensioned and configured to receive a protruding longitudinal ridge on the T-post.

6. A fence ladder comprising:

a front section and a rear section, said front section and said rear section each formed of a pair of risers with a plurality of rungs disposed therebetween;

a post receiver between said front section and said rear section, said receiver formed of a shell having a plurality of peripheral notches that are each positioned, spaced and dimensioned to receive outwardly-extending flanges on a fence post;

means for locking said front section to said second section to prevent shifting and separation, wherein said means for locking said front section to said second section includes a rod having a latch at one end gripping one of said risers, a threaded portion at an opposing end and a threaded locking knob attachable to the threaded end of said rod that is rotated to tighten said latch against said one of said risers, and to tighten said knob against another of said risers;

a receptacle on one of said risers for storing said rod when not in use, wherein said receptacle includes a shaft extending through an opening formed on one of said risers, said shaft including multiple apertures for receiving a pin to removably secure said receptacle.

* * * * *